United States Patent [19]

Pugh

[11] Patent Number: 4,503,651

[45] Date of Patent: Mar. 12, 1985

[54] RIDGE LATCH PLATE AND COOPERATING LATCH PIN

[76] Inventor: John B. Pugh, 3016 Graham La., Tampa, Fla. 33618

[21] Appl. No.: 388,481

[22] Filed: Jun. 14, 1982

[51] Int. Cl.[3] ..... E04B 1/32

[52] U.S. Cl. ..... 52/639; 403/330; 52/741

[58] Field of Search ..... 52/127.1, 127.2, 227, 52/639, 693, 641, 584, 741; 403/217, 330, 401, 402, 403, 231, 233; 292/25, 31, 44, 54, 130, 136, 230, 238, 132, 232, 234; 24/327, 351

[56] References Cited

U.S. PATENT DOCUMENTS

| | | | |
|---|---|---|---|
| 427,180 | 5/1890 | MacLaurin | 403/49 |
| 776,747 | 12/1904 | Kling | 292/132 |
| 1,762,883 | 6/1930 | Norman | 292/230 |
| 2,447,865 | 8/1948 | McClintock | 52/726 X |
| 2,517,185 | 8/1950 | Elmer | 292/130 |
| 2,662,798 | 12/1953 | Kirkpatrick | 403/49 |
| 2,883,713 | 4/1959 | Zug | 52/71 |

FOREIGN PATENT DOCUMENTS

| | | | |
|---|---|---|---|
| 846584 | 8/1960 | United Kingdom | 292/130 |

*Primary Examiner*—Carl D. Friedman
*Assistant Examiner*—Naoko N. Slack
*Attorney, Agent, or Firm*—Frijouf, Rust & Pyle

[57] ABSTRACT

A pair of ridge latch plates and cooperating latch pin is disclosed for joining together two beams of a constructional arch. The invention includes a latch pin which extends through one of the beams with the respective ends of the latch pin being engaged by latches pivotably mounted on latch plates secured on opposite sides of the other beam. Guides are provided on each latch plate for guiding the protruding ends of the latch pin into engagement with the distal ends of each latch.

9 Claims, 8 Drawing Figures

RIDGE LATCH PLATE AND COOPERATING LATCH PIN

BACKGROUND OF THE INVENTION

1. Field of the Invention

This invention relates to a ridge latch plate and cooperating latch pin for joining together two beams of a constructional arch.

2. Description of the Prior Art

Various types of connecting devices have been devised by the prior art for interconnecting the terminal ends of structural beams. These connecting devices secure the position of one beam relative to the other beam when the beams are in the appropriate positions.

U.S. Pat. No. 3,646,725 to A. L. Troutner, discloses a two-piece connector for joining pitched truss members in which the load imposed by the truss member is borne by cooperating bearing faces provided on each connector. The connectors are locked together at any desired angle relative to one another by a central bolt and cooperating nut. Each connector is attached to a truss member and the two connectors are bolted together prior to installation at the roof.

U.S. Pat. No. 4,050,210 to Gilb describes a truss connecting device having a pair of identical U-shaped channels. Each channel accommodates a truss and is secured to the truss by bolts. Each channel has an integral flap providing a compression plate which cooperates with the compression plate on the other channel. No means are disclosed for automatically latching the channels together.

In the building construction industry, due to the ever-increasing demand for unobstructed floor space, the trend has been towards roof arch beams of large dimensions. Such massive beams are usually installed using a crane or heavy moving equipment. When the two beams of an arch have been aligned at the ridge of the roof, it becomes necessary for workmen to gain access to the ridge in order to lock the two beams together. Reaching the ridge of such aligned beams is firstly a hazardous occupation as the workmen are operating on two beams, each of which is separately supported by a crane. This joint operation is also carried out at a considerable height from the ground. Secondly, elaborate equipment is required to transport the workmen to the roof ridge. This equipment usually includes a workmen's cradle with attendant pulleys and control mechanisms. Thirdly, the cost of the operation is considerable in terms of the time required by the workmen in gaining access to roof ridge and additionally, the time taken to join the beams together.

The present invention has as its primary objective and advantage, the provision of a pair of ridge latch plates and cooperating latch pin which will automatically lock two constructional beams together without the need of manually joining the beams of the arch together.

Another object of this invention is the provision of a pair of ridge latch plates and cooperating latch pin which avoids the hazardous and costly operation of elevating a workmen to the roof ridge.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention within the scope of the disclosure. Particularly with regard to the invention disclosed herein, it should not be construed as limited to the joining of constructional beam arches, but should include the joining together of a plurality of beams in the construction industry by cooperating latch plates and latch pins.

SUMMARY OF THE INVENTION

The ridge latch plates and cooperating latch pin of the present invention is defined by the appended claims with a specific embodiment shown in the attached drawings. For the purpose of summarizing the invention, the invention relates to a pair of ridge latch plates and cooperating latch pin for joining together a pair of constructional beams to form an arch. A latch pin having two ends extends through one of the constructional beams. The ends of the latch pin protrude from the opposite sides of the beam. A pair of ridge latch plates are secured adjacent opposite sides of the other beam. Each latch plate includes a latch pivotably mounted to the latch plate. The distal ends of each of the latches engage the protruding ends of the latch pin. Each of the latch plates has a guide for guiding the end of the latch pin toward the distal end of the latch for engagement therewith.

In a more specific embodiment of the invention, the latch pin is located within the beam by locating dowels. Additionally, the guide on the latch plate is defined by the peripheral edge of the latch plate with the guide being widest at the edge of the latch plate remote from the latch pivot and narrowing down towards the distal end of the latch. With a pair of latch plates, the ends of the respective latch plates remote from the latch pivot are flared outwardly relative to each other. These flared ends facilitate the guidance of a constructional beam and attendant latch pin into engagement with a corresponding pair of latch plates secured to a second beam.

The distal end of each latch has a sloping edge for cooperation with a corresponding end of the latch pin. As the two constructional beams approach each other, the sloping edge of the latch bears against the end of the latch pin to pivot the latch about the latch plate until the end of the latch pin is firmly latched within a groove defined by the latch. With the end of the latch pin located within the groove of the latch, this end of the latch pin is also located within the narrow end of the guide defined by the latch plate. A stop is disposed on the side of the latch plate on which the latch is mounted. The stop limits the rotation of the latch relative to the latch plate.

The foregoing has outlined rather broadly the more pertinent and important features of the present invention in order that the detailed description of the invention that follows may be better understood so that the present contribution to the art can be more fully appreciated. Additionally, features of the invention will be described hereinafter which form the subject of the claims of the invention. It should be appreciated by those skilled in the art that the conception and specific embodiment disclosed may be readily utilized as a basis for modifying or designing other devices for carrying out the same purposes of the present invention. It should also be appreciated by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following description taken in conjunction with the accompanying drawings in which.

Similar reference characters refer to similar parts throughout the several views of the drawing.

DETAILED DESCRIPTION

Figure 1:
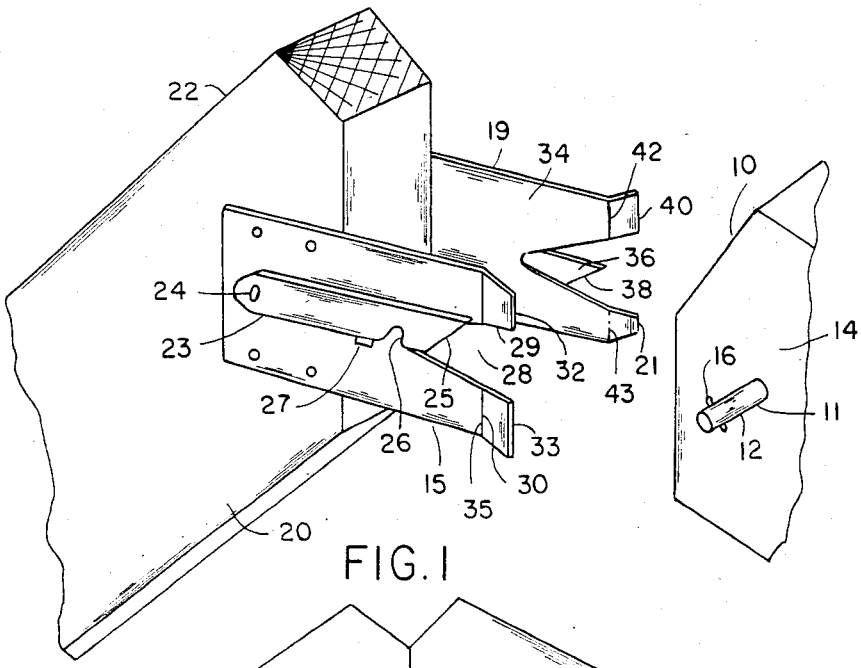
FIG. 1 is a perspective view of a pair of ridge latch plates and a cooperating latch pin.
Figure 2:
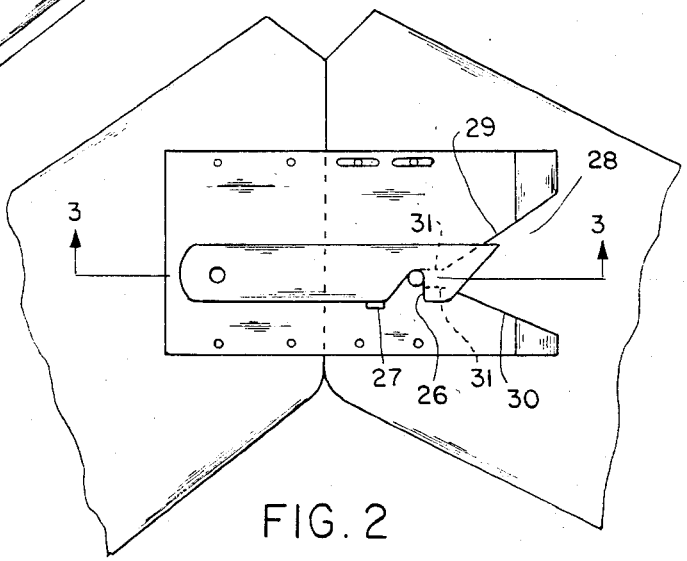
FIG. 2 is a side elevational view of a latch plate and a latch pin in the engaged position.
Figure 3:
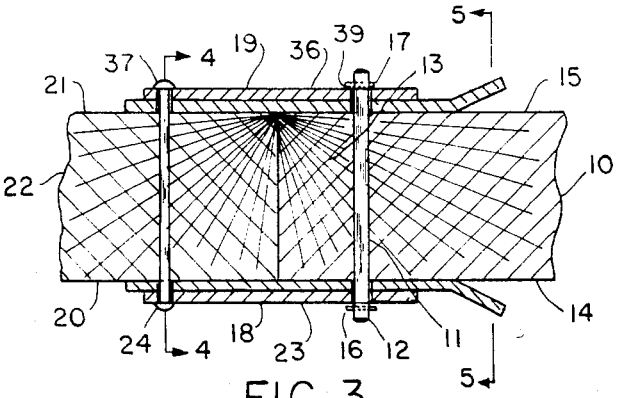
FIG. 3 is a cross-sectional view taken on line 3—3 of FIG. 2.
Figure 4:
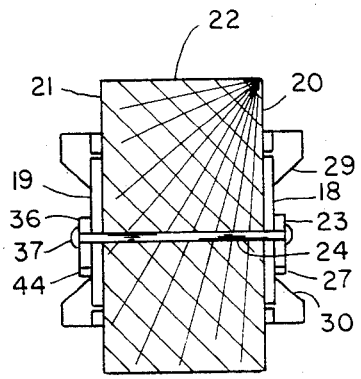
FIG. 4 is cross-sectional view taken on line 4—4 of FIG. 3.
Figure 5:
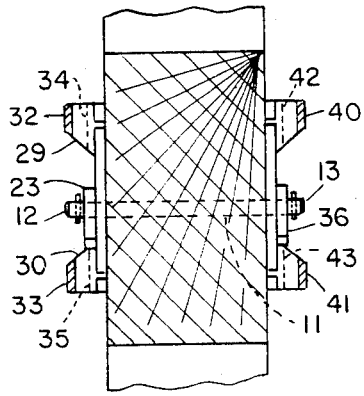
FIG. 5 is a cross-sectional view taken on line 5—5- of FIG. 3.

FIG. 1 is a perspective view of a pair of ridge latch plates and cooperating latch pin in which a first constructional beam, generally designated 10, has a latch pin 11 extending therethrough. An end 12 of the latch pin 11 protrudes from a first side 14 of the beam 10. A dowel 16 passes through the end 12 of latch pin 11 to locate the latch pin 11 within beam 10. As shown more particularly with reference to FIG. 3, the other end 13 of latch pin 11 protrudes from the opposite side 15 of beam 10. The end 13 also has a dowel 17 to locate latch pin 11 within the beam 10. A pair of ridge latch plates, generally designated 18 and 19, cooperate with the ends 12 and 13 respectively, of latch pin 11. The latch plates 18 and 19 are secured adjacent sides 20 and 21 respectively, of a second constructional beams, generally designated 22. The first latch plate 18 has a first latch 23 pivotably mounted on the latch plate 18 by a pivot pin 24. A sloping edge 25 of the distal end of the latch 23 bears against the end 12 of latch pin 11 to rotate the latch 23 relative to the pivot pin 24 until the end 12 of the latch pin 11 is firmly latched within groove 26 defined by the distal end of the latch 23.

A stop 27 disposed on the latch plate 18 on the same side of the latch plate as the latch 23, limits the rotation of the latch 23 relative to the latch plate 18. A guide, generally designated 28, is defined by edges 29, 30 and 31 respectively, of latch plate 18. Guide 28 is wider at ends 32 and 33 of the latch plate 18 remote from the pivot pin 24 whereas the guide is narrowest at a location adjacent the groove 26 of the latch 23. The function of the guide 28 is to guide the end 12 of latch pin 11 towards the sloping edge 25 of latch 23 and then towards groove 26 of the latch 23 to lock the end 12 of the latch pin 11 within the groove 26. The ends 32 and 33 of latch plate 18 are flared outwardly about lines 34 and 35, respectively so as to facilitate the guidance of the first beam 10 between the ridge latch plates 18 and 19 respectively.

The second latch plate 19 is identical to latch plate 18 except in that it is constructed in reverse relative to the latch plate 18. Thus the latch plate 19 is a mirror image of latch plate 18. Latch plate 19 is secured to the second side 21 of the second beam 22. The second latch 36 is pivotably mounted on latch plate 19 by pivot pin 37 so that the sloping edge 38 will bear against the end 13 of the latch pin 11 to rotate the latch 36 relative the latch plate 19 until the end 13 of the latch pin is latched within a groove 39 defined by the distal end of the latch 36. The edges 40 and 41 of latch plate 19 are flared outwardly about lines 42 and 43, respectively to facilitate the guidance of the side 15 of the first beam 10 between the latch plates 18 and 19. The latch plates 18 and 19 are secured adjacent the sides 20 and 21 of the beam 22 by means of screws, nails, or any other suitable anchoring means. The stop 27 and a corresponding stop 44 for the latch 36 are either stamped from the metal of the latch plates 18 and 19 respectively, or are fabricated separately and welded at the correct location on the latch plates 18 and 19.

Figure 6:
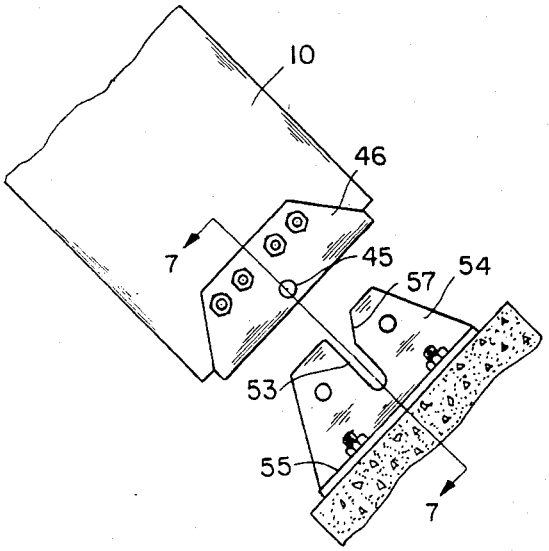
FIG. 6 is a side elevational view of the pintle at the bottom of the constructional beam.

FIG. 6 is a side elevational view of the pintle at the bottom of a constructional beam 10. A pintle 45 is rigidly secured to the sidewall 46 of an inverted metallic saddle 47. The saddle 47 is mounted upon the bottom of the beam 10 by means of wood screws 48 having threaded shanks 49 and cooperating nuts 50. The saddle 47 also has a sidewall 51 having a pintle 52 disposed thereon. Alternatively, the saddle may be secured to the bottom of the beam by means of bolts (not shown) passing through aligned apertures defined by the sidewalls 46 and 51 respectively.

The pintle 45 is supported within a socket groove 53 defined by the sidewall 54 of a base mounting saddle 55. The saddle 55 is secured to the concrete foundation structure of a building by bolts and nuts 56. The socket groove 53 has a wider portion 57 at its upper end so that when the constructional beam is lowered into position, the pintle 45 is guided within the socket groove 53 by the portion 57. The saddle 55 has another side 58 provided with a socket groove identical with that defined by side 54 for the reception of the pintle 52 therein.

Figure 8:
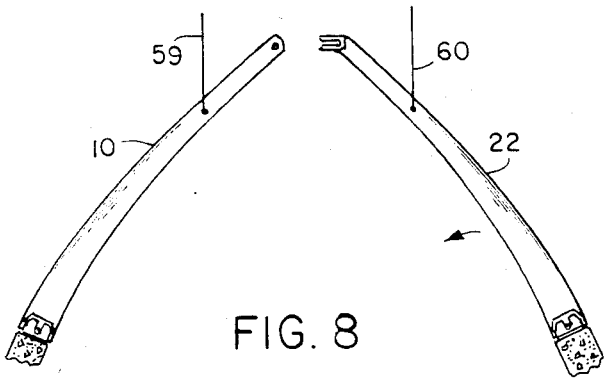
FIG. 8 is a side elevational view of a pair of constructional beams according to the present invention.
Figure 7:
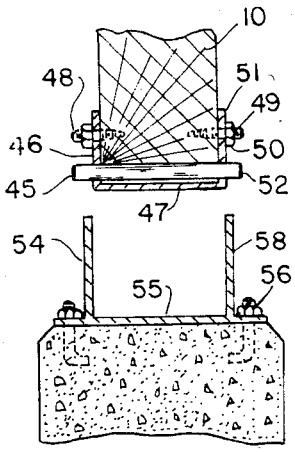
FIG. 7 is a cross-sectional view taken on line 7—7 of FIG. 6.

Two constructional beams 10 and 22 are shown in FIG. 8. These beams are supported by wire hawsers 59 and 60, respectively. Beam 10 is shown with the pintles 45 and 52 already located within the socket grooves of the base mounting saddle 55. The beam 22 is being lowered into engagement with the socket grooves.

When the pintles and sockets have been engaged the upper ends of the beams can be connected by means of the latch pin and cooperating latch plates as hereinbefore described.

An important feature of the present invention is the provision of a pair of latch plates which can be manipulated from a remote location and which will automatically engage the ends of a latch pin to lock two constructional beams of an arch together.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A device for interconnecting two beams of a constructional arch, comprising in combination:

a latch pin having a first and a second end;

said latch pin extending through a first of said beams;

each of said ends protruding from an opposite side of said first beam;

a first and a second latch plate being disposed respectively in a first and a second plane, said planes being parallel relative to each other, said latch plates cooperating with said latch pin;

means for securing each of said first and second latch plates adjacent an opposite side of a second of said beams;

a first and a second latch pivotably mounted on said first and second latch plates respectively, distal ends of said first and said second latches engaging said first and said second ends of said latch pins respectively;

a first and a second flared portion of said first and said second latch plates respectively for guiding said first beam between said latch plates, said portions being divergently flared relative to each other, said portions diverging from the respective planes of said plates; and a first and second guide defined by said first and said second latch plates respectively for guiding said first and said second ends respectively of said latch pin towards the distal ends of said first and said second latches respectively for rigidly securing said beams together.

2. A pair of ridge latch plates and cooperating latch pin as set forth in claim 1, wherein each of said distal ends has a sloping edge which bears on a cooperating end of said latch pin for rotating said latch relative to said latch plate.

3. A pair of ridge latch plates and cooperating latch pin as set forth in claim 2, wherein each of said latches has a groove which cooperates with an end of said latch pin to lock therein.

4. A pair of ridge latch plates and cooperating latch pin as set forth in claim 2, wherein relative rotation between said latch and said latch plate is limited by a stop disposed on said latch plate.

5. A pair of ridge latch plates and cooperating latch pin as set forth in claim 1, wherein said guide is defined by said latch plate;

said guide being widest at an end of said plate remote from the latch pivot and narrowest at the position on said latch plate adjacent a groove in said latch.

6. A pair of ridge latch plates and cooperating latch pin as set forth in claim 5, wherein each of said latch plates has drillings therein for receiving means for securing said latch plates to said opposite sides of said first and said second beams.

7. A pair of ridge latch plates and cooperating latch pin as set forth in claim 6, wherein each of said latch plates is of steel.

8. A pair of ridge latch plates and cooperating latch pin as set forth in claim 1, wherein each end of said latch pin has a dowel for locating said latch pin within said first beam.

9. A method of automatically joining together two beams of a constructional arch including the steps of:

inserting a latch pin through a first of the beams;

the latch pin having a first and a second end which protrude from opposite sides of the first beam;

securing a first latch plate on one side of a second beam and securing a second latch plate on the opposite side of the second beam;

said first and said second latch plate being disposed respectively in a first and a second plane, said planes being parallel relative to each other, said latch plates cooperating with said latch pin; means for securing each of said first and second latch plates adjacent an opposite side of a second of said beams;

a first and a second latch pivotably mounted on said first and second latch plates respectively, distal ends of said first and said second latches engaging said first and said second ends of said latch pins respectively;

a first and a second flared portion of said first and said second latch plates respectively for guiding said first beam between said latch plates, said portions being divergently flared relative to each other, said portions diverging from the respective planes of said plates; and a first and second guide defined by said first and said second latch plates respectively for guiding said first and said second ends respectively of said latch pin towards the distal ends of said first and said second latches respectively for rigidly securing said beams together;

and bringing together the first and the second beams enabling the first and the second ends of the latch pin to engage the distal end of the first and the second latches respectively.

* * * * *